US005256515A

United States Patent [19]

Law et al.

[11] Patent Number: 5,256,515

[45] Date of Patent: Oct. 26, 1993

[54] TONER COMPOSITIONS WITH HALOGENATED METAL SALICYCLIC ACID COMPLEX CHARGE ENHANCING ADDITIVES

[75] Inventors: Kock-Yee Law, Penfield; Ihor W. Tarnawskyj, Webster, both of N.Y.

[73] Assignee: Xerox Corporation, Stamford, Conn.

[21] Appl. No.: 978,572

[22] Filed: Nov. 19, 1992

[51] Int. Cl.[5] ..... G03G 9/083; G03G 9/097

[52] U.S. Cl. ..... 430/106.6; 430/110

[58] Field of Search ..... 430/106.6, 110

[56] References Cited

U.S. PATENT DOCUMENTS

| | | | |
|---|---|---|---|
| 4,206,064 | 6/1980 | Kiuchi et al. | 430/106 |
| 4,298,672 | 11/1981 | Lu | 430/108 |
| 4,378,420 | 3/1983 | Gruber et al. | 430/120 |
| 4,404,271 | 9/1983 | Kawagishi et al. | 430/110 |
| 4,411,974 | 10/1983 | Lu et al. | 430/106 |
| 4,656,112 | 4/1987 | Kawagishi et al. | 430/110 |
| 4,762,763 | 8/1988 | Nomura et al. | 430/110 |
| 4,767,688 | 8/1988 | Hashimoto et al. | 430/110 |
| 4,845,003 | 7/1989 | Kiriu et al. | 430/110 |

FOREIGN PATENT DOCUMENTS

| | | | |
|---|---|---|---|
| 306861 | 12/1989 | Japan | 430/110 |
| 48673 | 2/1990 | Japan | 430/110 |
| 48674 | 2/1990 | Japan | 430/110 |

*Primary Examiner*—Roland Martin
*Attorney, Agent, or Firm*—E. O. Palazzo

[57] ABSTRACT

A negatively charged toner composition comprised of resin particles, pigment particles, optional surface additives, and a halogenated salicyclic acid complex charge enhancing additive of the following formula:

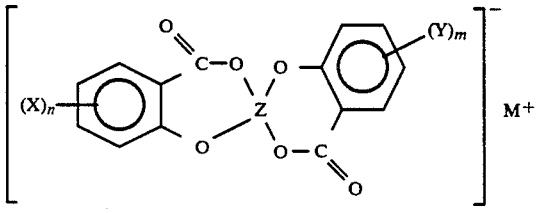

wherein wherein Z is zinc or chromium; M is hydrogen, an alkali metal, an alkaline earth metal, $NH_4$, or $NR_4$ wherein R is alkyl; X and Y are independently selected from the group consisting of chloride, iodide and bromide; and n and m are the numbers 1 or 2.

20 Claims, No Drawings

TONER COMPOSITIONS WITH HALOGENATED METAL SALICYCLIC ACID COMPLEX CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In one embodiment, there are provided in accordance with the present invention toner compositions comprised of resin particles, pigment particles and certain charge enhancing additives. In embodiments the present invention is directed to toners with halogenated zinc and chromium salicylic acid complex acid charge enhancing additives. The aforementioned charge additives in embodiments of the present invention enable, for example, toners with rapid triboelectric charging characteristics, extended developer life, stable triboelectrical properties irrespective of changes in environmental conditions, and high image print quality with substantially no background deposits. Also, the aforementioned toner compositions usually contain a colorant component comprised of, for example, carbon black, magnetites, or mixtures thereof, color pigments or dyes with cyan, magenta, yellow, blue, green, red, or brown, or mixtures thereof thereby providing for the development and generation of black and/or colored images. The toner and developer compositions of the present invention can be selected for electrophotographic, especially xerographic imaging and printing processes, including color processes.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with certain chromium, cobalt, and nickel complexes as negative charge enhancing additives. In U.S. Pat. No. 4,845,003 there are illustrated negatively charged toners with certain aluminum salt charge additives. More specifically, this patent discloses as charge additives aluminum complexes comprised of two or three hydroxybenzoic acid ligands bonded to a central aluminum ion. While these charge additives may have the capability of imparting negative triboelectric charge to toner particles, they are generally not efficient in promoting the rate of triboelectric charging of toner particles. A fast rate of triboelectric charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Another disadvantage with these charge additives is their thermal instability, that is they often break down during the thermal extrusion process of the toner manufacturing cycle. Most or many of these and other disadvantages are eliminated, or substantially eliminated with the toners containing the charge additives of the present invention.

Also of interest are U.S. Pat. Nos. 4,404,271; 4,656,112; 4,762,763; 4,845,003; 4,767,688; 4,378,420 and 4,433,040. Two of the charge additives of the aforementioned prior art, namely 1:2 boron 3,5-di-tertiary-butylsalicylic acid complex, or 1:2 boron 3,5-dibutylsalicylic acid complex, when added to toner compositions have inferior characteristics, such as tribocharging characteristics, as compared to the toners of the present invention.

Developer compositions with charge enhancing additives, which impart a positive charge to the toner particles, are known. Thus, for example, there is described in U.S. Pat. No. 3,893,935 the use of quaternary ammonium salts as charge control agents for electrostatic toner compositions; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; similar teachings are presented in U.S. Pat. No. 4,291,112 wherein A is an anion including, for example, sulfate, sulfonate, nitrate, borate, chlorate, and the halogens; U.S. Pat. No. 4,338,390, the disclosure of which is totally incorporated herein by reference, discloses developer compositions containing as charge enhancing additives organic sulfate and sulfonates, which additives can impart a positive charge to the toner composition; U.S. Pat. No. 4,298,672, the disclosure of which is totally incorporated herein by reference, discloses positively charged toner compositions with resins and pigment particles, and as charge enhancing additives alkyl pyridinium compounds.

Illustrated in copending patent application U.S. Ser. No. 894,688 (D/92080) are toner compositions comprised of polymer resins, colorants comprised of color pigment particles or dye molecules, and certain metal complex charge additives derived from the reaction of a mixture of a hydroxybenzoic acid and a base with a metal ion in the presence of an excess of a hydroxyphenol. More specifically, the copending application illustrates a negatively charged toner composition comprised of polymer, colorant, optional surface additives, and a metal complex charge enhancing additive of the following formula

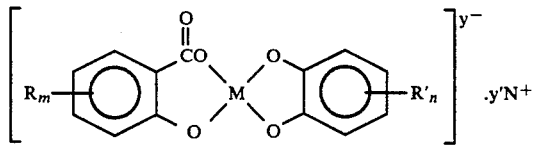

where M is a metal; N+ is a cation; R and R' are alkyl, alkoxy, aryloxy, halogen, carbonyl, amino, nitro, or mixtures thereof; m and n are the number of R substituents ranging from 0 to 3; y- is the magnitude of the negative charge of the anion; and y' represents the number of cations.

Illustrated in copending patent applications U.S. Ser. No. 894,690 (D/92081) is a negatively charged toner composition comprised of a polymer or polymers, pigment, and a metal complex charge enhancing additive as essentially represented by the following formula

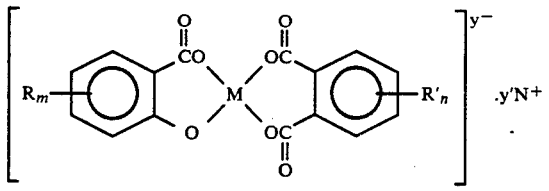

where M is the central metal ion; N+ is the counter cation; R and R' are selected from the group consisting of alkyl, alkoxy, aryloxy, halogen, carbonyl group, alkoxycarbonyl group, amino group, nitro group or mixtures thereof; m and n are the number of R substituents on the aromatic rings, ranging from 0 to 3; y- is the magnitude of the negative charge of the anion or the number of the counter cations of the metal complex, and represents the number 1 or 2; and y' represents the number of counter cations N+; U.S. Ser. No. 964,544 (D/92402) is a toner composition comprised of a polymer or polymers, pigment particles and/or dyes, optional surface additives, and a charge enhancing additive of the following formula

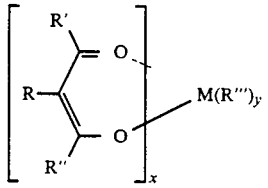

wherein R is hydrogen, alkyl, or aryl, R' and R'' are selected from the group consisting of alkyl, alkoxy, aryl, and aryloxy, R''' is selected from the group consisting of alkyl, alkoxy, oxide, and halide, M is boron or a metal, x is a number of from 1 to 4, and y is a number of from 0 to 2; and U.S. Ser. No. 964,541 (D/92403) is a negatively charged toner composition comprised of polymer, pigment, optional surface additives, and a zinc complex charge enhancing additive represented by either of the two following formulas

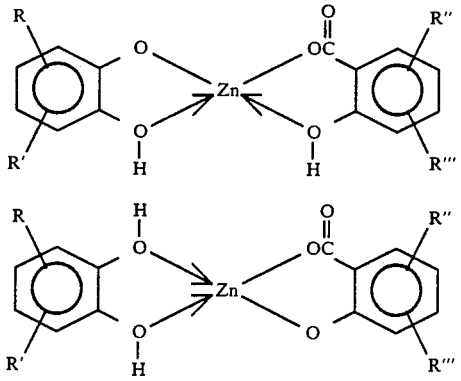

wherein R, R', R'', and R''' are independently selected from the group consisting of hydrogen, alkyl, aryl alkoxy, aryloxy, halogen, amino, and hydroxy. The disclosures of each of the aforementioned copending applications are totally incorporated herein by reference.

Although many charge enhancing additives are known, there continues to be a need for charge enhancing additives which, when incorporated in toners, render the toners with many of the advantages illustrated herein. There is also a need for economical negative charge enhancing additives which are useful for incorporation into black and colored toner compositions which can be utilized for developing positively charged electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can, therefore, form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negatively charged toner compositions which have desirable triboelectric charge levels of, for example, from between about −10 to about −50 microcoulombs per gram, and preferably from about −15 to about −30 microcoulombs per gram, and triboelectric charging rates of less than about 120 seconds as measured by standard charge spectrograph methods when the toners are frictionally charged against suitable carrier particles via conventional roll milling techniques. There is also a need for nontoxic, substantially nontoxic, or environmentally compatible charge enhancing additives which when incorporated at effective concentrations of, for example, less than 7 weight percent, and preferably less than 4 weight percent in toners, render environmentally acceptable toners. The concentrations of the charge additives that can be present generally range from about 0.05 weight percent to about 5 weight percent, depending on whether the charge additive is utilized as a surface additive or as a dispersion in the bulk of the toner. The effective concentrations of toner in the developer, that is toner and carrier particles, are, for example, from about 0.5 to about 5 weight percent, and preferably from about 1 to about 3 weight percent.

SUMMARY OF THE INVENTION

It is an object of the present invention to provide toner and developer compositions with negative charge enhancing additives.

Another object of the present invention resides in the provision of negatively charged toner compositions useful for the development of electrostatic latent images including color images.

In yet a further object of the present invention there may be provided, it is believed, humidity insensitive, of from about, for example, 20 to 80 percent relative humidity at temperatures of from 60° to 80° F. as determined in a relative humidity testing chamber, negatively charged toner compositions with desirable triboelectric charging rates of less than 120 seconds, and more specifically, from 15 seconds to about 2 minutes as determined by the charge spectrograph method, and acceptable triboelectric charging levels of from about −10 to about −50 microcoulombs per gram.

Another object of the present invention resides in the preparation of negative toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is for example those exceeding 50 copies per minute.

Also, in another object of the present invention there are provided processes for the preparation of the charge additives illustrated herein, which enable toners with high triboelectric charging characteristics.

These and other objects of the present invention may be accomplished in embodiments thereof by providing toner compositions comprised of polymer resins, colorants comprised of color pigment particles or dye molecules, and certain charge additives. More specifically, the present invention in embodiments is directed to toner compositions comprised of resin, pigment, and a negative charge enhancing additive of the formula:

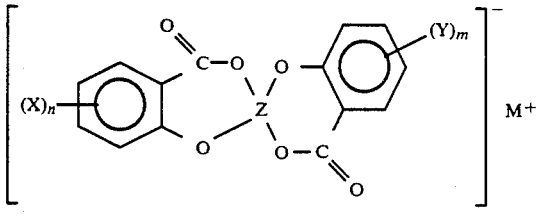

wherein Z is zinc, boron, or chormium, M is hydrogen, alkali, or alkaline earth metals such as lithium, calcium, potassium, cesium, $NH_4$, magnesium, calcium, barium, $NR_4$, wherein R is alkyl, X and Y are independently selected from the group consisting of halogens like iodide, chloride, fluoride and bromide, and n and m are the numbers 1 or 2. These complexes may form the corresponding hydrates with water.

Examples of alkyl include known substituents such as those with 1 to about 25 carbon atoms, such as methyl, ethyl, propyl, butyl, pentyl, heptyl, octyl, decyl, and the like.

Examples of specific charge additives include bis(3,5-diiodosalicylato) zinc, bis(3,5-dibromosalicylato) zinc, bis(3,5-dichlorosalicylato) zinc, bis(5-iodosalicylato) zinc, bis(5-bromosalicylato) zinc, bis(3,5-diiodosalicylato) chromium, bis(3,5-dibromosalicylato) chromium, bis(3,5-dichlorosalicylato) chromium, bis(5-iodosalicylato) chromium, bis(5-iodosalicylato) chromium, bis(5-bromosalicylato) chromium, potassium bis(3,5-diiodosalicylato) borate, lithium bis(3,5-diiodosalicylato) borate, potassium bis(3,5-dibromosalicylato) borate, lithium bis(3,5-dibromosalicylato) borate, and the like.

The aforementioned charge additives can be incorporated into the toner, may be present on the toner surface, or may be present on toner surface additives such as colloidal silica particles. Advantages of rapid admix charging characteristics of generally less than 120 seconds in embodiments as measured by the standard charge spectrograph methods when the toners are frictionally charged against carrier particles by known conventional roll mixing, appropriate triboelectric charge levels, and the like can be achieved with many of the aforementioned toners of the present invention. In another embodiment of the present invention, there are provided, subsequent to known micronization and classification, toner particles with a volume average diameter of from about 4 to about 20 microns.

The halogenated zinc salicylic acid complexes of the present invention can be prepared, for example, by heating a boron, chromium or zinc salt, such as zinc sulfate with a halogenated salicylic acid, such as 3,5-diiodosalicylic acid and 3,5-dibromosalicylic acid, in an aqueous solution at from about 50° to 100° C. in the presence of a base, such as NaOH, KOH, and the like. The ratio of the zinc salt to the salicylic acid can be 1:10 with 1:4 being preferred. The product is collected by filtration and can be purified by washing with water or alcohol like methanol. Similarly, the halogenated chromium salicylic acid complex of the present invention can be prepared by reacting a halogenated salicylic acid with a chromium salt, such as chromium sulfate, in an aqueous alcoholic solution at about 50° to 100° C. The product is again collected by filtration and can be purified by washing with dilute acid, like 1 percent of $H_2SO_4$, and water. Further purification, such as by recrystallization from a mixture of DMF and water, affords pure chromium complexes. The complexes of the present invention, such as the zinc and chromium complex charge additives, can be characterized by conventional technique, such as melting point, infrared spectroscopy and elemental analysis.

The toner compositions of the present invention can be prepared by a number of known methods such as admixing and heating polymer resins such as styrene butadiene copolymers, colorants such as color pigment particles or dye compounds, and the aforementioned charge enhancing additive, or mixtures of charge additives in a concentration preferably ranging from about 0.5 percent to about 5 percent in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 4 to about 25 microns, and preferably from about 4 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; polyurethanes; polyamides and polyimides; polyesters; and the like. The polymer resins selected for the toner compositions of the present invention include homopolymers or copolymers of two or more monomers. Furthermore, the above mentioned polymer resins may also be crosslinked depending on the desired toner properties. Illustrative vinyl monomer units selected for the vinyl polymers include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol segments in the polyester resins include ethanediol, propanediols, butanediols, pentanediols, pinacol, cyclopentanediols, hydrobenzoin, bis(hydroxyphenyl)alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Ser. Nos. 814,641, and 814,782, the disclosures of which are totally incorporated herein by reference, can be selected as toner resins. Other specific toner resins include styrene-methacrylate copolymers, and styrenebutadiene copolymers; PLIOLITES®; suspension polymerized styrenebutadienes, reference U.S. Pat. No. 4,558,108, the disclosure of which is totally incorporated herein by reference. Also, waxes with a molecular weight of from about 1,000 to about 6,000 such as polyethylene, polypropylene, and paraffin waxes can be included in or on the toner compositions as fuser roll release agents.

The toner resin is present in a sufficient, but effective amount, for example from about 30 to about 95 weight percent. Thus, when 1 percent by weight of the charge enhancing additive is present, and 8 percent by weight of colorant, such as carbon black or color pigment, is contained therein, about 91 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent. Also, in embodiments the charge additive may be admixed with colloidal silica particles and absorbed on the surface thereof, and the resulting product can then be applied to the toner as a surface additive.

Numerous well known suitable color pigments or dyes can be selected as the colorant for the toner compositions including, for example, carbon black, like REGAL 330®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 70, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated by the fluidized bed spray process or by solution coating methods with the charge additives of the present invention illustrated herein in an amount of from about 1 to about 50 weight percent and preferably 10 weight percent to about 25 weight percent followed by the addition thereof to the toners in an amount of from 0.1 to 10 and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 6,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Embraced within the scope of the present invention are colored toner and developer compositions comprised of toner resins, optional carrier particles, the change enhancing additives illustrated herein, and as colorants red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as colorants include copper phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In embodiments, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity via frictionl charging against the toner particles of the present invention. The opposite charge polarities of the carrier and toner particles of the developer composition thus ensure adherence to the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from between about 80 and 200 microns in average diameter thereby permitting them, for example, to possess sufficient density and inertia to avoid adherence to the electrostatic images during the development process. The carrier component can be mixed with the toner composition in various suitable combinations, such as about 1 to 5 parts of toner to about 100 parts to about 200 parts by weight of carrier.

The toner composition of the present invention can be prepared by a number of known methods including extrusion melt blending the toner resins, colorants, and the halogenated zinc, chromium, boron salicylic acid complex charge enhancing additives of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can first be prepared, followed by addition of the charge enhancing additive and other optional surface additives, or the charge enhancing additive-treated surface additive such as colloidal silicas. Further, other methods of preparation for the toner are as illustrated herein.

The toner and developer compositions of the present invention may be selected for use in electrostatographic imaging and printing apparatuses containing therein conventional photoreceptors providing that they are capable of forming positive electrostatic latent images relative to the triboelectric charge polarity of the toners.

The toners of the present invention are usually jetted and classified subsequent to preparation to enable toner particles with a preferred volume average diameter of from about 4 to about 25 microns, and more preferably from about 4 to about 12 microns. The triboelectric charging rates for the toners of the present invention are in embodiments less than 120 seconds as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 30 grams per minute; and further, such toner compositions can be selected for high speed electrophotographic apparatuses, that is those exceeding 50 copies per minute.

The following Examples are being supplied to further illustrate various embodiments of the present invention, it being noted that these Examples are intended to illustrate and not limit the scope of the present invention.

EXAMPLE I

Synthesis of Bis(3,5-diiodosalicylato) Zinc

An aqueous solution of zinc sulfate (2.43 grams of $ZnSO_4.7H_2O$ in 10 milliliters of water) was added over a period of 15 minutes to a warm (about 70° C.) solution containing 3,5-diiodosalicylic acid (3.9 grams, 5 millimoles) in 25 milliliters of 2 percent NaOH. A white precipitate was observed immediately. The mixture was heated and stirred for another two hours after the completion of the addition. The product mixture was cooled to room temperature, and a white solid was isolated by filtration. The desirable product, the above zinc diiodosalicylic acid complex, was purified by first dissolving the crude product in methanol and then precipitating it by adding water. The yield was 2.63 grams (62 percent) after vacuum drying.

| | |
|---|---|
| m.p.: | >220° C. (dec.) |
| IR (KBr): | about 1,560 and 1,610 $cm^{-1}$. |
| Calculated for $C_{14}H_6O_6I_4Zn$: | C 19.9, H 0.72, I 60.2, Zn 7.8 |
| Found: | C 19.3, H 0.87, I 59.5, Zn 8.1 |

EXAMPLE II

Synthesis of Bis(3,5-dibromosalicylato) Zinc

Bis(3,5-dibromosalicylato) zinc was synthesized by repeating the procedure of Example I, with the exception that 3,5-dibromosalicylic acid was used in place of the 3,5-diiodosalicylic acid, and the yield was about 40 percent.

| | |
|---|---|
| m.p.: | >250° C. |
| IR (KBr): | about 1,560, 1,580 and 1,610 $cm^{-1}$. |
| Calculated for | |
| $C_{14}H_{10}O_8Br_4Zn$: | C 24.3, H 1.5, Br 46.2, Zn 9.5 |
| Found: | C 23.9, H 1.3, Br 45.0, Zn 10.0 |

EXAMPLE III

Synthesis of Potassium Bis(3,5-diiodosalicylato) Borate

Boric acid (0.31 gram, 5 millimoles), potassium hydroxide (0.34 gram, 5 millimoles) and 3,5-diiodosalicylic acid (1.95 gram, 5 millimoles) were dissolved in about 50 milliliters of water at about 80° C. in a 200 milliliter beaker: A 2-propanol solution (about 15 milliliters) containing 1.95 gram of 3,5-diiodosalicylic acid was added dropwise. After the addition was completed, the mixture was heated to boiling to evaporate off the 2-propanol. After further heating for 16 hours, the mixture was cooled to room temperature, about 25° C., and the white precipitated product was isolated by filtration to yield a crude product of 2.84 grams. The product was purified by stirring with dilute aqueous potassium hydroxide. After filtration and vacuum drying, 2.29 grams (56 percent) of potassium bis(3,5-diiodosalicylato) borate was obtained.

| | |
|---|---|
| m.p.: | 305° C. |
| IR (KBr): | 1,686 $cm^{-1}$(C = O). |

-continued

| | |
|---|---|
| Calculated for | |
| $C_{14}H_4O_6I_4Bk$: | C 20.3, H 0.49, I 61.4, B 1.3, K 4.7 |
| Found | C 19.7, H 0.50, I 60.6, B 1.3, K 4.2 |

EXAMPLE IV

Synthesis of Potassium Bis(3,5-dibromosalicylato) Borate

Pure potassium bis(3,5-dibromosalicylato) borate was synthesized by repeating the procedure of Example III, with the exception that 3,5-dibromosalicylic acid was used in place of the 3,5-diiodosalicylic acid, and the yield was 44 percent.

| | |
|---|---|
| m.p.: | 310° C. |
| IR (KBr): | 1,690 $cm^{-1}$(C = O). |
| Calculated for | |
| $C_{14}H_4O_6Br_4Bk$: | C 26.4, H 0.63, Br 50.1, B 1.7, K 6.1 |
| Found | C 25.9, H 0.69, Br 50.0, B 1.7, K 6.4 |

EXAMPLE V

Synthesis of Bis(3,5-diiodosalicylato) Chromium

An aqueous solution of chromium sulfate (1 gram in 1.5 milliliter solution) was added slowly to a warm (about 60° C.) solution containing 3,5-diiodosalicylic acid (3.9 grams, 5 millimoles) in about 40 milliliters of methanol. An aqueous solution of NaOH (25 percent) was added to the reaction mixture to adjust the pH of the solution to 4 to 5. A light green precipitate was observed immediately. The mixture was heated and stirred for another three hours. It was cooled to 40° C. and the precipitated product was isolated by filtration. The product was then purified by washing with dilute sulfuric acid (1 percent) and then water until the filtrate was neutral. Further purification was carried out by washing the solid with ether and recrystallization from a mixture of DMF and water to yield pure bis(3,5-diiodosalicylato) chromium, 1.04 gram (about 24 percent).

| | |
|---|---|
| m.p.: | 300° C: |
| IR (KBr): | about 1,642 $cm^{-1}$. |

EXAMPLE VI

Synthesis of Bis(3,5-dibromosalicylato) Chromium

Bis(3,5-dibromosalicylato) chromium was synthesized and purified by repeating the procedure of Example V, with the exception that 3,5-dibromosalicylic acid was used in place of the 3,5-diiodosalicylic acid, to yield about 20 percent of the above charge additive.

| | |
|---|---|
| m.p.: | about 310° C. |
| IR (KBr): | about 1,555 and 1,585 $cm^{-1}$. |

EXAMPLE VII

There were prepared toners with the negative charge additive prepared in Example I, bis(3,5-diiodosalicylato) zinc. The charge additive, 0.3 gram, was dissolved in about 100 milliliters of methanol in a 250 milliliter round bottom flask. AEROSIL R972 ®from Degussa (3.0 grams) was added and the resulting suspension was stirred for 0.5 hour. The solvent was then removed on a rotary evaporator. The residue obtained was transferred to a crystallization dish where it was dried in an oven overnight, about 20 hours at 120° C. The solid was then transferred to a 4 ounce bottle and roll milled with 35 grams of ¼ inch steel shot for 30 minutes at a speed of 90 feet/minute, yielding 3 grams of a fluffy white powder, comprised of 10 percent by weight of bis(3,5-diiodosalicylato) zinc and 90 percent of AEROSIL R972®. The formed white powder charge additive composite, 0.063 gram, was then added together with 12.5 grams of (1) styrene butadiene (91/9), and (2) polyester SPAR II® toner in two separate 4 ounce bottles containing 125 grams of steel shot of ¼ inch diameter and the bottles were then roll milled for 30 minutes.

Developer compositions were then prepared by adding 1.25 grams of the above toners and 60 grams of a steel core carrier, 130 microns in diameter and 0.8 percent by weight of a surface coating of polymethylmethacrylate (PMMA) with 20 percent carbon black, and then roll milled for 60 minutes at a speed of 90 feet/minute to generate the time zero developers. The tribos and the admix times were evaluated by the known Faraday Cage method and the charge spectrograph, respectively. The results were:

| TONER RESIN | TRIBO Microcoulombs/gram | ADMIX |
|---|---|---|
| Styrene Butadiene | −37.7 | 2 minutes |
| SPAR II ®-Polyester | −17.9 | 1 minute |

EXAMPLE VIII

There were prepared toners with the negative charge additives prepared in Examples II, III, IV, V and VI. Toners and developers were prepared according to the procedures of Example VII. The tribo and admix results are summarized in the following Table.

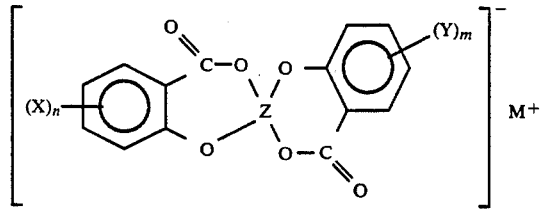

wherein Z is zinc or chromium; M is hydrogen, an alkali metal, an alkaline earth metal, $NH_4$, or $NR_4$ wherein R is alkyl; X and Y are independently selected from the group consisting of chloride, iodide and bromide; and n and m are the numbers 1 or 2.

2. A toner composition in accordance with claim 1 wherein M is selected from the group consisting of hydrogen, lithium, sodium, potassium, cesium, magnesium, calcium, barium, and $NR_4$ wherein R is methyl.

3. A toner composition in accordance with claim 1 wherein X and Y are iodide, bromide or chloride.

4. A toner composition in accordance with claim 1 wherein the charge additive is present in an amount of from about 0.05 to about 5 weight percent.

5. A toner composition in accordance with claim 1 wherein the charge additive is present in an amount of from about 0.1 to about 3 weight percent.

6. A toner composition in accordance with claim 1 wherein the charge additive is incorporated into the toner.

7. A toner composition in accordance with claim 1 wherein the charge additive is present on the surface of the toner composition.

8. A toner composition in accordance with claim 7 wherein the charge additive is contained on colloidal silica particles or titanium dioxide particles.

9. A toner composition in accordance with claim 1 wherein the toner's rate of charging is from about 15 seconds to about 120 seconds by frictional charging against suitable carrier particles.

| EXAMPLE | CHARGE ADDITIVE | XEROGRAPHIC RESULTS WITH STYRENE BUTADIENE (91/9) TONER | | XEROGRAPHIC RESULTS WITH SPAR II TONER | |
|---|---|---|---|---|---|
| | | TRIBO | ADMIX | TRIBO | ADMIX |
| II | bis(3,5-dibromosalicylato) zinc | −39.9 μC/g | 1 minute | −16.1 μC/g | 1 minute |
| III | potassium bis(3,5-diiodosalicylato) borate | −48.8 μC/g | 2 minutes | −15.6 μC/g | 30 seconds |
| IV | potassium bis(3,5-dibromosalicylato) borate | −42.2 μC/g | 2 minutes | −11.7 μC/g | 30 seconds |
| V | bis(3,5-diiodosalicylato) chromium | −61.9 μC/g | 1 minute | −19.3 μC/g | 1 minute |
| VI | bis(3,5-dibromosalicylato) chromium | −59.0 μC/g | 2 minutes | −22.6 μC/g | 1 minute |

Other modifications of the present invention may occur to those skilled in the art subsequent to a review of the present application, and these modifications, including equivalents thereof, are intended to be included within the scope of the present invention.

What is claimed is:

1. A negatively charged toner composition comprised of resin particles, pigment particles, optional surface additives, and a halogenated salicyclic acid complex charge enhancing additive of the following formula:

10. A toner composition in accordance with claim 1 with a negative triboelectric charge of from between about −10 to about −50 microcoulombs per gram.

11. A toner composition in accordance with claim 1 wherein the resin particles are selected from the group consisting of styrene acrylates, styrene methacrylates styrene butadienes, polyesters, or crosslinked polyesters.

12. A toner composition in accordance with claim 1 containing a wax component which has a weight average molecular weight of from about 1,000 to about 6,000.

13. A toner composition in accordance with claim 12 wherein the wax component is selected from the group consisting of polyethylene and polypropylene.

14. A toner composition in accordance with claim 1 wherein surface additives of metal salts of a fatty acid, colloidal silicas, or mixtures thereof are added to said toner.

15. A toner composition in accordance with claim 1 wherein the pigment particles are carbon black, magnetites, or mixtures thereof, cyan, magenta, yellow, red, blue, green, or brown, or mixtures thereof.

16. A developer composition comprised of the toner composition of claim 1 and carrier particles.

17. A developer composition in accordance with claim 16 wherein the carrier particles are selected from the group consisting of ferrites, steel or an iron powder with a polymer or mixtures of polymers coating thereover.

18. A developer composition in accordance with claim 16 wherein the coating is selected from the group consisting of a methyl terpolymer, a polyvinylidine fluoride, a polymethyl methacrylate, or a mixture of polymers not in close proximity in the triboelectric series.

19. A toner composition in accordance with claim 1 wherein the charge additive is bis(3,5-diiodosalicylato) zinc, bis(3,5-dibromosalicylato) zinc, bis(3,5-dichlorosalicylato) zinc, bis(5-iodosalicylato) zinc, bis(5-bromosalicylato) zinc, bis(3,5-diiodosalicylato) chromium, bis(3,5-dibromosalicylato) chromium, bis(3,5-dichlorosalicylato) chromium, bis(5-iodosalicylato) chromium, or bis(5-bromosalicylato) chromium.

20. A toner composition in accordance with claim 11 wherein the charge additive is bis(3,5-diiodosalicylato) zinc, bis(3,5-dibromosalicylato) zinc, bis(3,5-dichlorosalicylato) zinc, bis(5-iodosalicylato) zinc, bis(5-bromosalicylato) zinc, bis(3,5-diiodosalicylato) chromium, bis(3,5-dibromosalicylato) chromium, bis(3,5-dichlorosalicylato) chromium, bis(5-iodosalicylato) chromium, or bis(5-bromosalicylato) chromium.

* * * * *